US011391138B2

(12) United States Patent
Winkler et al.

(10) Patent No.: US 11,391,138 B2
(45) Date of Patent: Jul. 19, 2022

(54) ACID FRACTURING WITH DISSOLVABLE PLUGS

(71) Applicant: Halliburton Energy Services, Inc., Houston, TX (US)

(72) Inventors: Albert Winkler, Singapore (SG); Andrew Penno, Singapore (SG); Michael Linley Fripp, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 103 days.

(21) Appl. No.: 16/765,982

(22) PCT Filed: May 8, 2020

(86) PCT No.: PCT/US2020/032257
§ 371 (c)(1),
(2) Date: May 21, 2020

(87) PCT Pub. No.: WO2020/236444
PCT Pub. Date: Nov. 26, 2020

(65) Prior Publication Data

US 2021/0404305 A1 Dec. 30, 2021

Related U.S. Application Data

(60) Provisional application No. 62/852,153, filed on May 23, 2019, provisional application No. 62/852,108,
(Continued)

(51) Int. Cl.
*E21B 43/26* (2006.01)
*E21B 43/27* (2006.01)
(Continued)

(52) U.S. Cl.
CPC ..... *E21B 43/261* (2013.01); *E21B 33/13* (2013.01); *E21B 43/116* (2013.01);
(Continued)

(58) Field of Classification Search
CPC ..... E21B 33/12; E21B 43/26; E21B 33/134; E21B 33/1293; E21B 33/128; E21B 33/129; E21B 33/1208
See application file for complete search history.

(56) References Cited

U.S. PATENT DOCUMENTS 3,078,797 A 2/1963 Blair
4,244,424 A 1/1981 Talbot
(Continued)

FOREIGN PATENT DOCUMENTS

CN 107013181 A 8/2017
EP 1264075 B1 6/2018
(Continued)

OTHER PUBLICATIONS

Korean Intellectual Property Office, PCT/US2020/026222, International Search Report and Written Opinion, dated Jul. 27, 2020, 13 pages, Korea.
(Continued)

*Primary Examiner* — Zakiya W Bates
(74) *Attorney, Agent, or Firm* — Haynes and Boone, LLP

(57) ABSTRACT

Acid stimulation operations in a wellbore may be conducted using frac plugs constructed of a hydrolytically degradable polymer. The frac plugs may be constructed of an aliphatic polyester such as PGA and may be readily pumped into position in the wellbore due in part to their relatively low density. Once perforations have been created in the wellbore and a first frac plug is set in place, an acid solution may be pumped at a high-pressure acid against the frac plug and into the geologic formation. A second and/or any number of
(Continued)

subsequent frac plugs may be pumped behind the acid, e.g., in brine solution, to be used in subsequent acid stimulation operations. After completing acid stimulation operations, the frac plugs may degrade in the wellbore to permit production.

20 Claims, 4 Drawing Sheets

Related U.S. Application Data filed on May 23, 2019, provisional application No. 62/852,129, filed on May 23, 2019, provisional application No. 62/852,161, filed on May 23, 2019.

(51) Int. Cl.

| | |
|---|---|
| ***E21B 33/13*** | (2006.01) |
| ***E21B 33/12*** | (2006.01) |
| ***E21B 43/267*** | (2006.01) |
| ***E21B 43/116*** | (2006.01) |

(52) U.S. Cl.

CPC ..... *E21B 43/267* (2013.01); *E21B 43/27* (2020.05); *E21B 2200/08* (2020.05)

(56) References Cited

U.S. PATENT DOCUMENTS

| | | | |
|---|---|---|---|
| 7,322,416 | B2 | 1/2008 | Burris, II et al. |
| 7,363,967 | B2 | 4/2008 | Burris, II et al. |
| 8,276,670 | B2 | 10/2012 | Patel |
| 8,342,094 | B2 | 1/2013 | Marya et al. |
| 8,496,052 | B2 | 7/2013 | Frazier |
| 8,677,903 | B2 | 3/2014 | Marya et al. |
| 9,133,695 | B2 | 9/2015 | Xu |
| 9,217,319 | B2 | 12/2015 | Frazier et al. |
| 9,464,508 | B2 | 10/2016 | Lerche et al. |
| 9,587,475 | B2 | 3/2017 | Frazier et al. |
| 9,671,201 | B2 | 6/2017 | Marya et al. |
| 9,695,677 | B2 | 7/2017 | Moody-Stuart et al. |
| 9,797,238 | B2 | 10/2017 | Frosell et al. |
| 9,920,621 | B2 | 3/2018 | Frosell et al. |
| 9,963,955 | B2 | 5/2018 | Tolman et al. |
| 10,082,008 | B2 | 9/2018 | Robey et al. |
| 2012/0152519 | A1 | 6/2012 | Rodgers et al. |
| 2013/0062055 | A1 | 3/2013 | Tolman et al. |
| 2013/0292174 | A1 | 11/2013 | Harvey et al. |
| 2014/0027127 | A1 | 1/2014 | Frazier et al. |
| 2015/0275643 | A1 | 10/2015 | Holder et al. |
| 2016/0040520 | A1 | 2/2016 | Tolman et al. |
| 2017/0175500 | A1 | 6/2017 | Robey et al. |
| 2017/0234103 | A1 | 8/2017 | Frazier |
| 2017/0314372 | A1 | 11/2017 | Tolman et al. |
| 2018/0163503 | A1 | 6/2018 | Fripp et al. |
| 2018/0171744 | A1 | 6/2018 | Markel et al. |

FOREIGN PATENT DOCUMENTS

| | | | |
|---|---|---|---|
| WO | WO-2013184238 | A1 | 12/2013 |
| WO | WO-2018013131 | A1 | 1/2018 |

OTHER PUBLICATIONS

Korean Intellectual Property Office, PCT/US2020/032255, International Search Report and Written Opinion, dated Aug. 12, 2020, 17 pages, Korea.

Korean Intellectual Property Office, PCT/US2020/032257, International Search Report and Written Opinion, dated Aug. 20, 2020, 15 pages, Korea.

Korean Intellectual Property Office, PCT/US2020/032229, International Search Report and Written Opinion, dated Aug. 25, 2020, 12 pages, Korea.

ACID FRACTURING WITH DISSOLVABLE PLUGS

CROSS REFERENCE TO RELATED APPLICATIONS

This application is a U.S. national stage patent application of International Patent Application No. PCT/US2020/032257 filed on May 8, 2020, which claims priority to U.S. Provisional Application No. 62/852,153 filed May 23, 2019, entitled "Acid Fracturing with Dissolvable Plugs," the disclosure of which is hereby incorporated by reference. International Patent Application No. PCT/US2020/032257 also claims priority to U.S. Provisional Application No. 62/852,108 filed entitled "Locating Self-Setting Dissolvable Plugs", 62/852,129 entitled "Dissolvable Setting Tool for Hydraulic Fracturing Operations" and 62/852,161 entitled "Dissolvable Expendable Guns for Plug-and-Perf Applications", each filed on May 23, 2019, the disclosures of each of which are hereby incorporated by reference.

FIELD OF THE DISCLOSURE

This disclosure relates, in general, to hydraulic/acid fracturing or stimulation operations, e.g., acid stimulation or matrix stimulation operations, performed in subterranean wells. In particular, the disclosure relates to systems and methods for deploying a frac plug and perforating system for an acid stimulation or an acid matrix stimulation operation.

BACKGROUND

After drilling each section of a subterranean wellbore that traverses one or more hydrocarbon bearing subterranean formations, individual lengths of metal tubulars are typically secured together to form a casing string that is positioned within the wellbore. This casing string provides wellbore stability to counteract the geomechanics of the formation such as compaction forces, seismic forces and tectonic forces, thereby preventing the collapse of the wellbore. Conventionally, the casing string is cemented within the wellbore. To produce fluids into the casing string, hydraulic openings or perforations are typically made through the casing string and a distance into the formation.

Acid stimulation is a technique that may be employed to facilitate the production of fluids from the subterranean formations. High pressure inorganic acid may be injected into a carbonate formation such that the high pressure creates cracks that allow the acid to penetrate the formation. Subterranean wellbores for acid stimulation operations often include a vertical section extending from a surface location, a transition section and a relatively long horizontal section. For acid stimulation operations, various downhole tools, such as frac plugs, setting tools, and perforation guns, may be positioned in the wellbore. These downhole tools may be coupled together on a tool string known as a frac package, or these tools may be placed individually in the wellbore at the desired location.

It may be difficult, time consuming and expensive to deliver the tools to a distal end of the horizontal section using traditional methods such as pushing the tools into position using a tubing string. Frac plugs used to isolate portions of the wellbore during an acid stimulation operation must be milled or otherwise removed to permit production once the acid stimulation operation is complete. Milling the frac plugs may create metal cuttings that could interfere with subsequent operations if not removed from the wellbore.

These difficulties may limit the number of zones that may be acid fractured in the wellbore.

DESCRIPTION OF ILLUSTRATIVE EMBODIMENTS

Figure 1:
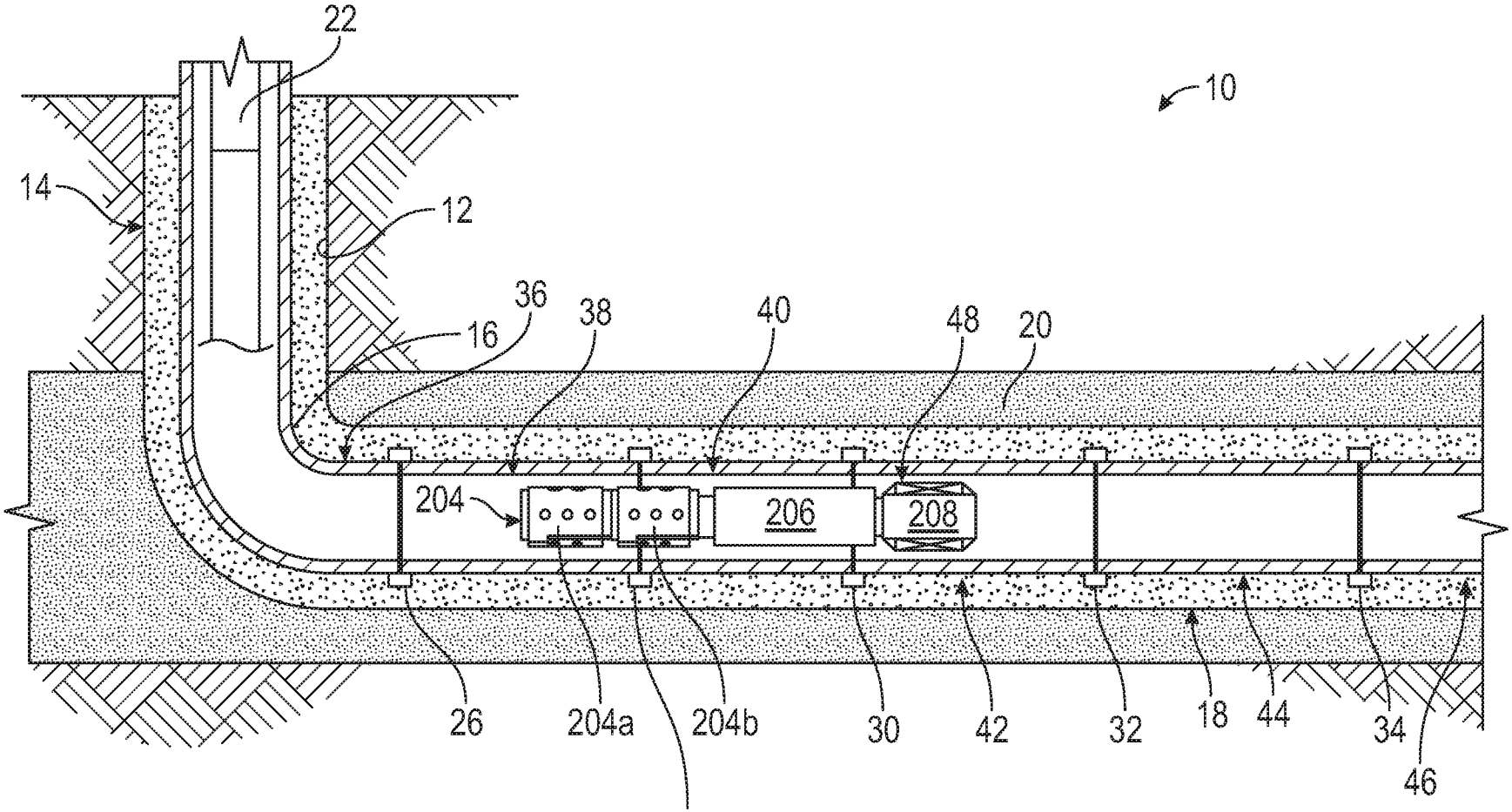
FIG. 1 is a schematic illustration of a wellbore system employing an untethered frac package, which may include a dissolvable plastic frac plug and that may be operated and secured at a predetermined position in the wellbore by detecting one or more passive depth markers in accordance with one or more example embodiments of the present disclosure.

Embodiments of the present disclosure relate to acid stimulation operations in a wellbore using frac plugs constructed of a hydrolytically degradable polymer. The frac plugs may be constructed of an aliphatic polyester such as PGA, and may be readily pumped into position in the wellbore due in part to the relatively low density of the frac plug. Once a first frac plug is set in place, an acid stimulation operation may be performed by pumping at high-pressure acid against the frac plug and into the geologic formation. A second frac plug (and any number of subsequent frac plugs) may be pumped behind the acid, e.g., in brine solution, to be used in a second acid stimulation operation (and any number of acid stimulation operations). After completing acid stimulation operations, the frac plugs may degrade in the wellbore to permit production within two weeks in some embodiments.

Traditional acid stimulation operations use cast iron frac plugs. The density of the cast iron is sufficiently high that these plugs are difficult to pump into the horizontal sections and often need tubing or coiled tubing to push them to position. After the cast iron plugs are deployed, the plugs must be milled to allow well production to take place. Milling of cast iron is time consuming, leading to additional rig downtime and can produce metal cuttings that are difficult to remove from the wellbore. As a result, the number of zones that are acid fractured are limited when cast iron frac plugs are used.

An alternative to using cast iron frac plugs is to use a dissolvable frac package that includes a dissolvable or hydrolytically degradable frac plug. Metallic dissolvable frac plugs are difficult to use in environments with high acid concentrations. The acid may rapidly accelerate the degradation of the metal used in the metallic dissolvable frac plugs that are typically made from a magnesium alloy or an aluminum alloy. The present disclosure relates to the use of a plastic dissolvable frac plug for use in acid stimulation. The plastic dissolvable frac plug self-removes during the dissolution process and eliminates the need to milling out the plug. The density of the plastic frag plug is substantially less than cast iron, which enables pumping into the long horizontal sections of the wellbore. In addition, the material makeup of the plastic frac plug may be adjusted to enhance resistance to concentrated acid. Deploying a plastic-based frac plug will allow for more stimulation stages and a more efficient acid stimulation operation.

After the hydraulic acid stimulation operation is complete, the dissolvable frac plugs, and/or other components of a frac package, may be dissolved in place without the difficulties and expense of removing the frac packages via a dedicated intervention with a service string or wireline, without requiring another run downhole, without milling out the cast iron frac plug and without the difficulties associated with leaving frac packages in the casing string. Removal of the frac package using a service string or wireline would require an additional run downhole and leads to additional rig downtime. Alternatively, if the frac package were left in the casing string future wellbore operations during wellbore production would be limited.

As used herein, a "dissolvable material" or a "degradable material" includes at least hydrolytically degradable materials such as elastomeric compounds that contain polyurethane, aliphatic polyesters, thiol, celloluse, acetate, polyvinyl acetate, polyethylene, polypropylene, polystyrene, natural rubber, polyvinyl alcohol, or combinations thereof. Aliphatic polyester has a hydrolysable ester bond and will degrade in water. Examples include polylactic acid, polyglycolic acid, polyhydroxyalkonate, and polycaprolactone. A "dissolvable material" may also include metals that have an average dissolution rate in excess of 0.01 mg/cm2/hr. at 200° F. in a 15% KCl solution. A component constructed of a dissolvable material may lose greater than 0.1% of its total mass per day at 200° F. in a 15% KCl solution. In some embodiments, the dissolvable metal material may include an aluminum alloy and/or a magnesium alloy. Magnesium alloys include those defined in ASTM standards AZ31 to ZK60. In some embodiments, the magnesium alloy is alloyed with a dopant selected from the group consisting of iron, nickel, copper and tin. A solvent fluid for a dissolvable material may include water, a saline solution with a predetermined salinity, an HCl solution and/or other fluids depending on the selection and arrangement of components constructed of the dissolvable material.

While the present disclosure is described herein with reference to illustrative embodiments for particular applications, it should be understood that embodiments are not limited thereto. Other embodiments are possible, and modifications can be made to the embodiments within the spirit and scope of the teachings herein and additional fields in which the embodiments would be of significant utility. Further, when a particular feature, structure, or characteristic is described in connection with an embodiment, it is submitted that it is within the knowledge of one skilled in the relevant art to implement such feature, structure, or characteristic in connection with other embodiments whether or not explicitly described.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to effect such feature, structure, or characteristic in connection with other embodiments whether or not explicitly described.

Illustrative embodiments and related methodologies of the present disclosure are described below in reference to FIGS. 1-7 as they might be employed. Other features and advantages of the disclosed embodiments will be or will become apparent to one of ordinary skill in the art upon examination of the following figures and detailed description. It is intended that all such additional features and advantages be included within the scope of the disclosed embodiments. Further, the illustrated figures are only exemplary and are not intended to assert or imply any limitation with regard to the environment, architecture, design, or process in which different embodiments may be implemented.

FIG. 1 is a schematic illustration of a wellbore system 10 in which an untethered dissolvable frac package 48 is deployed in a wellbore 12 according to an embodiment of the present disclosure. The frac package 48 is illustrated as including a perforating gun section 204, a setting tool 206 and a frac plug 208, which may be constructed of a hydrolytically degradable polymer, as described in greater detail below.

In the illustrated embodiment, the wellbore 12 extends through the various earth strata. Wellbore 12 has a substantially vertical section 14, and also has a substantially horizontal section 18 that extends through a hydrocarbon bearing subterranean formation 20. As illustrated in FIG. 1, a casing string 16 is cemented in both the vertical and horizontal sections 14, 18. In other embodiments, portions of the wellbore may be open hole.

It will be appreciated by those skilled in the art that even though FIG. 1 depicts a substantially vertical section 14 and substantially horizontal section 18 of the wellbore 12, the embodiments described in the present disclosure are equally applicable for use in wellbores having other directional configurations including deviated wellbores, slanted wellbores, diagonal wellbores, combinations thereof, and the like. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the wellbore.

Positioned within wellbore 12 and extending from the surface is an optional conveyance such as a tubing string 22, wireline, coiled tubing, etc. The frac package 48 is untethered from the tubing string 22. The frac package 48 may be lowered through the vertical section 14 on the tubing string 22 and untethered upon reaching the horizontal section 18. In other embodiments, the frac package 48 may deployed untethered from the surface without the tubing string 22, using wireline or other conveyance. Casing string 16 includes a plurality of couplings 26, 28, 30, 32, 34 each of which possesses a passive depth marker, such as at least one array of magnets. In some other embodiments, only a predetermined number of the couplings 26, 28, 32, 34 include a passive depth marker. In some embodiments, the passive depth markers may include passive radio frequency identification (RFID) tags or near-field communication (NFC) circuits. In some embodiments radioactive markers may be employed. The passive depth markers may include permanent magnets mechanically connected to tubing sections of the string 22, e.g. not necessarily on a coupling 26, 28, 30, 32, 34 defined between the tubing sections. In some embodiments, the passive depth markers may include a detectable change in magnetic permeability in the tubing. As illustrated, each coupling 26, 28, 30, 32, 34 is positioned between potential frac package setting points 36, 38, 40, 42, 44, 46 thereby defining potential production intervals. In the illustrated embodiment, couplings 26, 28, 30, 32, 34 serve to locate and position the frac package 48. Each coupling 26, 28, 30, 32, 34 may include a unique magnetic signature, or otherwise provide a uniquely identifiable signal, and in some embodiments, each coupling 26, 28, 30, 32, 34 include a similar magnetic signature or provide similar identifiable signals.

The frac package 48 includes a perforating gun section 204 at an upper end thereof, which may include one or more perforating guns 204*a*, 204*b*. In other embodiments, the perforating gun section 204 may be disposed at a different location within the frac package 48 without departing from the scope of the disclosure. A setting tool 206 is operably coupled between the perforating gun section 204 and a frac plug 208. The setting tool 206 may include a controller for detecting a predetermined depth in the wellbore 12, and for issuing trigger signals to actuators for setting the frac plug 208 and for firing the perforating guns 204*a*, 204*b*. The controller may include a magnetic field detector, RFID or NFC interrogator or similar device for detecting the passive depth markers in the casing string. The controller of the setting tool 206 may also include a memory preprogrammed with instructions for issuing the trigger signal to the actuators in response to detecting an appropriate depth in the wellbore.

It will be appreciated that in other embodiments, the perforating gun section 204, frac plug 208 and setting tool 206 could be coupled to one another in different arrangements. For example, in some embodiments, the setting tool 206 may be coupled below the frac plug 208. As illustrated in FIG. 1, the setting tool 206 is physically coupled between the perforating gun section 204 and the frac plug 208. In other embodiments, the setting tool 206 or portions thereof may be carried by either the frac plug 208 or the perforating gun section 204 without departing from the scope of the disclosure.

As depicted, frac package 48 can be pumped along the horizontal section 18 in a conveyance fluid towards the toe of the wellbore. The conveyance fluid pumped into the wellbore 12 conveys the frac package 48 downhole. In some embodiments (not shown) a frac package may include radially extending fins to facilitate centralization and a means of propelling the frac package with the fluid. The dissolvable frac package 48 senses the magnetic signature or other signal produced by each coupling 26, 28, 30, 32, 34, and the setting tool 206 within the frac package 48 sets the frac plug 208 at a predetermined location according to set point positions 36, 38, 40, 42, 44, 46 thereby defining the perforation points along the wellbore. As illustrated in FIG. 1, the perforating gun section 204 is illustrated as being pumped downhole along with the setting tool 206 and the frac plug 208. In other embodiments, the perforating gun section 204 may be pumped down separately once the frac plug 208 has been set.

Figure 2:
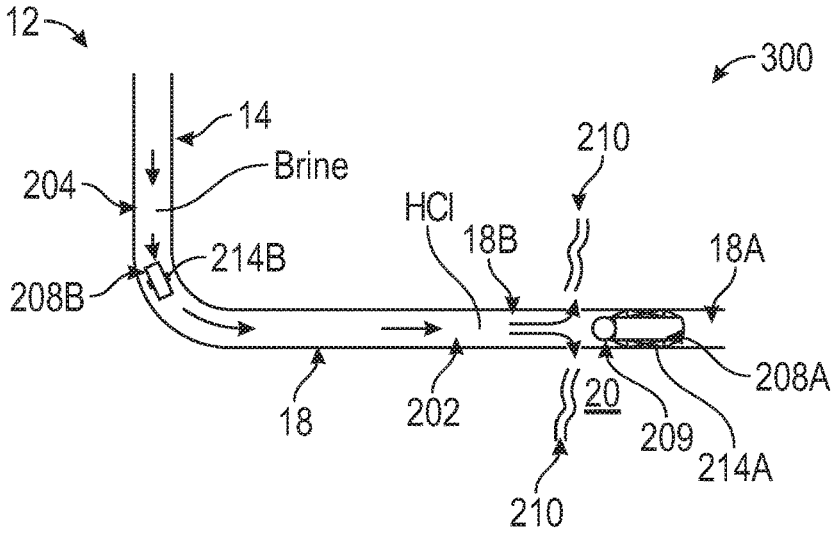
FIG. 2 is a schematic illustration of a wellbore system in which a first acid stimulation operation is conducted with a first dissolvable-plastic frac plug set in the wellbore while a second dissolvable-plastic frac plug is being pumped into position in the wellbore.
Figure 3:
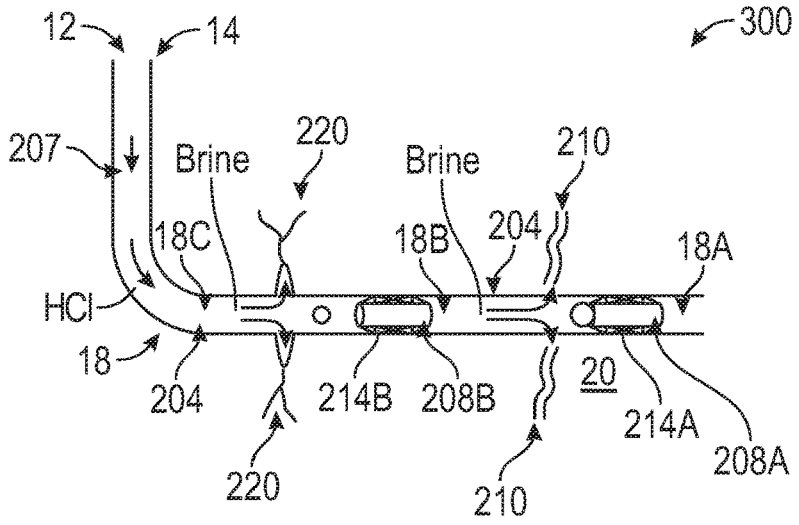
FIG. 3 is a schematic illustration of the wellbore system of FIG. 2 illustrating the second dissolvable-plastic frac-plug set in position for a second acid stimulation operation.
Figure 4:
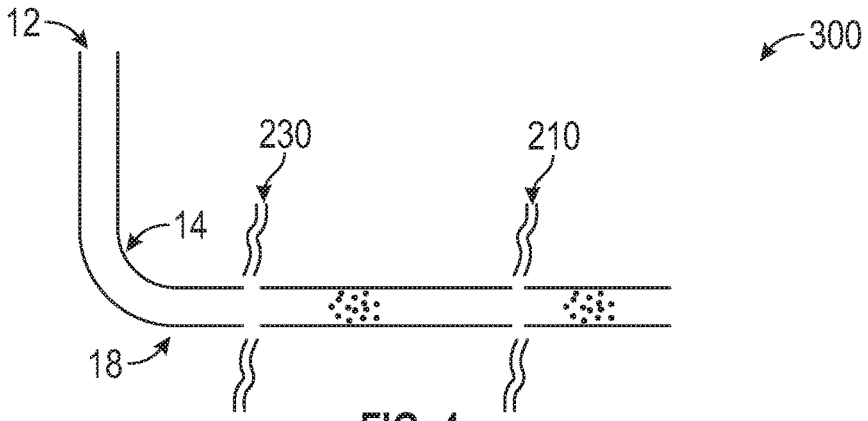
FIG. 4 is a schematic illustration of the wellbore system of FIG. 2 illustrating the first and second frac plugs having been dissolved once the acid stimulation operation is complete.

FIGS. 2 through 4 illustrate a wellbore system 300 in which various stages of a procedure for conducting acid stimulation or acid stimulation operations are being performed. The acid stimulation or acid stimulation operations may be performed with inorganic acids and/or organic acids. Example inorganic acids, which may be employed in stimulation and/or stimulation operations and/or to degrade portions of the frac package 48, include HCl, HF and phosphoric acid. Example suitable organic acids may include carboxylic acids, citric acid, lactic acid, formic acid, acetic acid.

In FIG. 2, a first frac plug 208A is illustrated in a set configuration in the horizontal section 18 of the wellbore. In the set position, the first frac plug 208A is radially expanded and engages a wall of the wellbore 12. The first frac plug 208A may have been a component of a frac package 48 (FIG. 1), which was pumped downhole in a water-based solution such as brine and may have been set in response to detecting a magnetic signature of one of the couplings 26, 28, 30, 32, 34 (FIG. 1). The perforating gun section 204 may have been employed to create perforations in the wellbore 12 either before or after the first frac plug 208A is set. The setting tool 206 may be preprogrammed to fire the perforating gun section 204 to create perforations or perforation clusters in any predetermined sequence or pattern in the wellbore 12. As illustrated, the perforating gun section 204 and setting tool 206 of the frac package 48 may have been removed, e.g., by wireline or by dissolving in the wellbore 12. In other embodiments, the first frac plug 208A may have been deployed individually by any other appropriate mechanism or for the sakes of initiating injection into the wellbore a frac initiation sleeve may have been integrated into the lower end of the casing string upon installation.

The first frac plug 208A engages the wall of the wellbore 12 with a frac plug element 214A in a radially extended configuration to isolate a region 18A below the first frac plug 208A from a region 18B above the first frac plug 208A. As illustrated, the first frac plug 208A includes a frac ball 209, which may seat within a fluid passage (see, e.g., FIG. 5) extending through the frac plug 208A to thereby fluidly isolate the wellbore regions 18A, 18B from one another. It will be appreciated that alternate embodiments of a frac plug in accordance with the present disclosure may not employ a frac ball 209 to isolate the wellbore regions 18A, 18B. High pressure (e.g., about 1000 psi to about 5000 psi) organic or inorganic acid 202 is pumped into wellbore against the first frac plug 208A through the perforated section (region 18B) and into the surrounding geologic formation 20. In some other embodiments, an acid stimulation operation may be performed in which acid is pumped into the wellbore 12 at a lower pressure, e.g., less than about 1000 psi. In some embodiments, the acid 202 may have a solid content less than about 5% by weight, and any solids within the acid may be less than about 100 microns in diameter. This solid content of the acid 202 may be a characteristic of an acid stimulation operation that is distinguishable from a hydraulic stimulation operation, which may be performed with fluids with a higher solids content. The acid 202 may be pumped at a pressure the below frac pressure or above the frac pressure, which induces the geologic formation 20 to fracture hydraulically. In embodiments in which the acid 202 is pumped below the frac pressure, the treatment may be referred to as a "matrix treatment," and cracks are not necessarily formed in the geologic formation 20. Cracks 220 (see FIG. 3) may be formed in the geologic formation 20 surrounding the wellbore 12, and the acid 202 in the cracks creates wormholes 210 into the geologic formation 20. In some embodiments, the acid 202 may dissolve the perforation gun section 204 and setting tool 206 of a frac package 48 (FIG. 1) at a faster rate than the first frac plug 208A such that the first frac plug 208A remains set and intact during the acid stimulation operation.

A second or subsequent frac plug 208B package is pumped downhole into the wellbore 12 through a combination of gravitational forces and hydraulic forces. The second frac plug 208B is pumped to the horizontal section 18 within a water-based fluid such as a column of brine 204 behind the acid 202 with a frac plug element 214B in a radially retracted configuration. The second frac plug 208B is illustrated independently, but it will be appreciated that the second frac plug 208B may be pumped downhole as part of a frac package 48 (FIG. 1) as described above to facilitate the formation of perforations and setting of the second frac plug 208B along the same lines in as the first frac plug system 10 described above.

As illustrated in FIG. 3, the second frac plug 208B is set by moving the frac plug element 214B to a radially extended configuration, isolating region 18B below the second frac plug 208B from a region 18C above the second frac plug 208A. A setting tool 206 (FIG. 1) may be provided with the frac plug 208B to move the frac plug element from the radially retracted configuration to the radially extended configuration. Perforations are formed into the geologic formation 20 such that the brine 204 may form cracks 220 in the geologic formation 20. The pressure fractures the geologic formation 20, and a column of acid 207 behind the brine 204 is pumped against the second frac plug 208B and into the cracks 220.

As illustrated in FIG. 4, wormholes 230 are formed by the acid 207 (FIG. 3). The first and second frac plugs 208A, 208B (FIG. 3) have been dissolved or hydrolytically degraded by the acid 202, 207, brine 204 or other fluids in the wellbore 12. The water in the fluids in the wellbore 12 causes the plastic materials in the frac plugs 208A, 208B to hydrolytically degrade, and the result is a wellbore 12 without tool restrictions as shown in FIG. 4. In some embodiments, the frac plugs 208A, 208B may degrade within two weeks of being pumped into the wellbore 12 to thereby permit production from the wellbore 12.

In some embodiments, the plastic frac plug is installed in the wellbore with a setting tool where the setting tool is returned to the surface with a wireline after the perforating gun dissolves downhole. In some other embodiments, the spent perforating guns are returned to the surface with the wireline and the setting tool is left to dissolve downhole.

Figure 5:
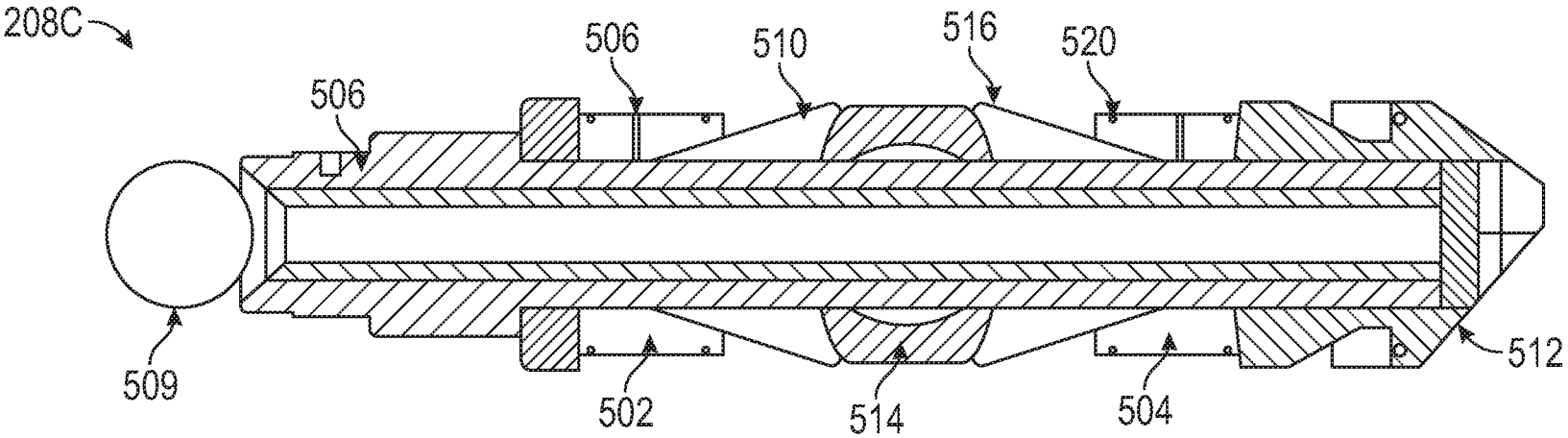
FIG. 5 is a cross-sectional view of a frac plug that may be employed in the wellbore systems of FIGS. 1 and 2, illustrating a frac plug having both top and bottom slips.

FIG. 5 illustrates an example of a frac plug 208C, which may be employed in the wellbore systems 10, 300 of FIGS. 1 and 2. The frac plug 208C includes both top or upper slips 502 and bottom or lower slips 504. In some embodiments, the frac plug 208C is composed of multiple materials. For example, some parts of the frac plug 208C can be constructed from a dissolvable plastic. Some other parts can be constructed from a dissolvable rubber or elastomer. Some other parts of the frac plug 208C can be constructed from a dissolvable metal. In order to protect the dissolvable metal components from premature dissolution in the acid 202 (FIG. 2), the metal components can be encapsulated or coated with a protective layer, to inhibit the degradation process until degradation is warranted. Types of coatings may include metal-based materials such as nickel and/or polymer-based materials. In some embodiments, an elastomeric barrier may be provided between the metal and components and the injected acid 202. While some other parts of the frac plug 208C can be constructed from non-dissolvable material, such as ceramic or hardened steel.

The frac plug 208C includes a mandrel 506, frac ball 509, upper slips 502, upper wedge 510, and mule shoe 512, each of which may be constructed from a fiber-reinforced dissolvable plastic. A frac plug element 514 could be constructed from a dissolvable elastomer. The lower wedge 516 and lower slips 504 could be constructed from a dissolvable metal, especially since these components may not be exposed to the acid 202 (FIG. 2) due to the engagement of sealing of the element 514 with the casing string 16 (FIG. 1) or wellbore wall. It may be advantageous to construct the lower wedge 516 and lower slips 504 from a dissolvable metal because the dissolvable metal materials may be stronger than plastic materials, and the lower slips 504 support the hydraulic forces exerted on the frac plug 208C. Teeth 520 that bite into the casing string 16 can be constructed from a non-dissolvable material, such as ceramic or a hardened steel. In this case, the frac plug element 514 may be composed of a degradable elastomer, the ball 509, upper wedge 510, and mule shoe 512 may be composed of a degradable plastic, the lower wedge 516 and lower slips 504 may be composed of a degradable metal, and the teeth 520 may be composed of a non-degradable material. The degradable plastic material may be one of aliphatic polyesters such as poly (lactic acid) (PLA) and poly (glycolic acid) (PGA). The degradable elastomer material may be one of polyurethane, thermoplastic urethane (TPU), and thiol. The degradable metal may be one of magnesium and aluminum alloys. The non-degradable materials may be one of steel, brass, ceramic, and cast iron. In one embodiment, the degradable materials may be coated with a protective layer to inhibit the degradation process. Types of coatings may be one of metal-based and/or polymer-based materials. The fiber reinforcements may include glass fibers, carbon fibers, ceramic fibers, and metal fibers.

Figure 6:
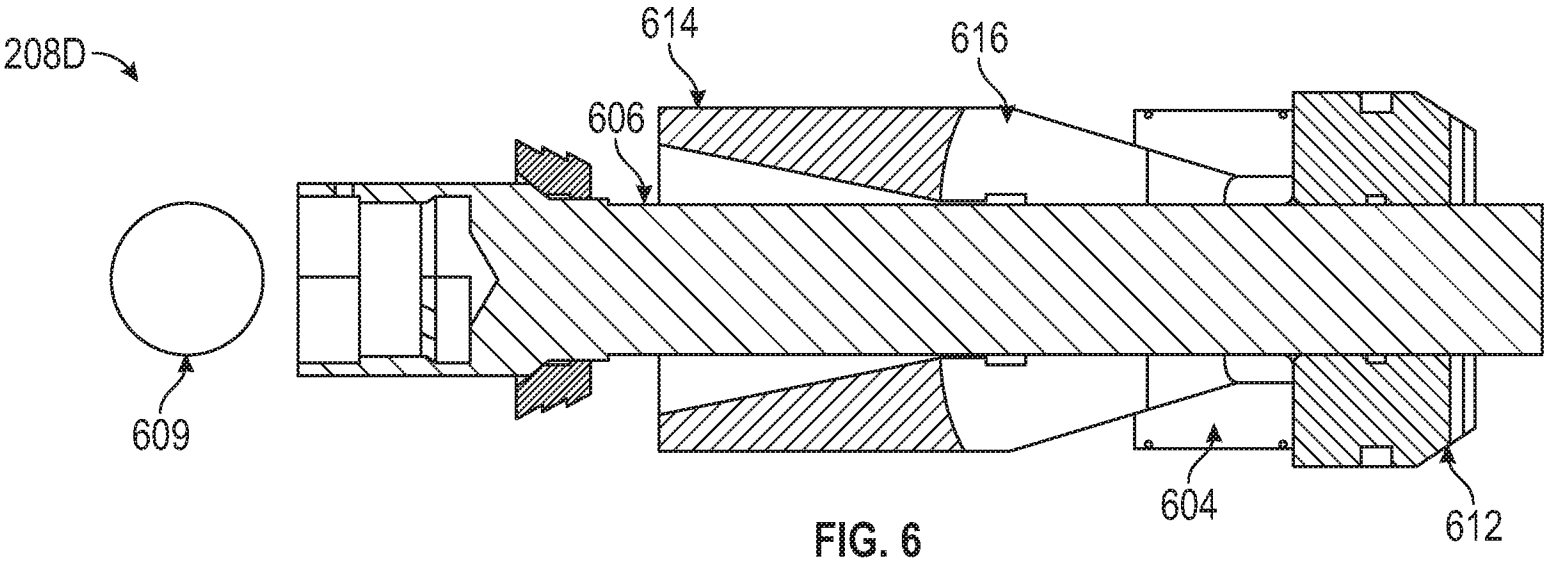
FIG. 6 is a cross sectional view of another embodiment of a frac plug that may be employed in the wellbore systems of FIGS. 1 and 2, illustrating a frac plug having only bottom slips.

Referring to FIG. 6, in some embodiments, a frac plug 208D may include only bottom or lower slips 604 below a frac plug element 614, and no slips above the fac plug element 614. The frac plug element 614 may be constructed of a degradable elastomer. A mandrel 606, ball 609, setting wedge 616, and mule shoe 612 may be composed of a degradable plastic, and the lower wedge 616 and lower slip 604 may be composed of a degradable metal. Teeth 620 in the slips 604 may be constructed of a non-degradable material.

Once the perforations through the casing string 16 are generated and a frac zone, e.g., region 18B (see FIG. 2), is isolated, acid stimulation or hydraulic stimulation operations can occur. In some embodiments, the acid or hydraulic stimulation operations may be performed with a combination of both proppant and acid. For example, the acid 207 (FIG. 3) may be pumped into the cracks 220 and permitted to form an emulsion. Thereafter, a proppant may be pumped down into the cracks 220.

Once the acid stimulation and/or hydraulic stimulation operation is completed, any remaining portions of the frac package 48 (FIG. 1) may be substantially degraded in the wellbore fluids. In some embodiments, the perforating gun section 204, setting tool 206, and frac plug 208 degrades in water-based fluids. In other embodiments, the frac package 48 degrades in an acid-based fluid. In some embodiments, the majority of the mass from each of the components in the frac-package degrades into individual particles less than one half inch diameter. In some embodiments, the frac package is composed of multiple materials that degrade in different fluids and at different rates.

For example, the perforating gun section 204 and the setting tool 206 may be composed of a degradable metal while the frac plug 208 is constructed of a combination of degradable materials such as metals, plastics, and elastomers. In proppant-based hydraulic stimulation, the hydraulic stimulation process may be initiated with acid, and then transitioned to majority proppant. In an acid-based hydraulic stimulation or stimulation process, acid is used extensively. By constructing the perforating gun 204 and the setting tool 206 from degradable metal, the acid will accelerate the degradation of these two frac package components 204, 206 at a faster rate than the frac plug 208. As a result, the perforating gun 204 and the setting tool 206 will degrade early in the hydraulic fracturing or stimulation operation. The plastic and elastomer components in the frac plug 208 are more resistant to acid and, therefore, will last longer during the hydraulic/acid fracturing or stimulation operation.

Figure 7:
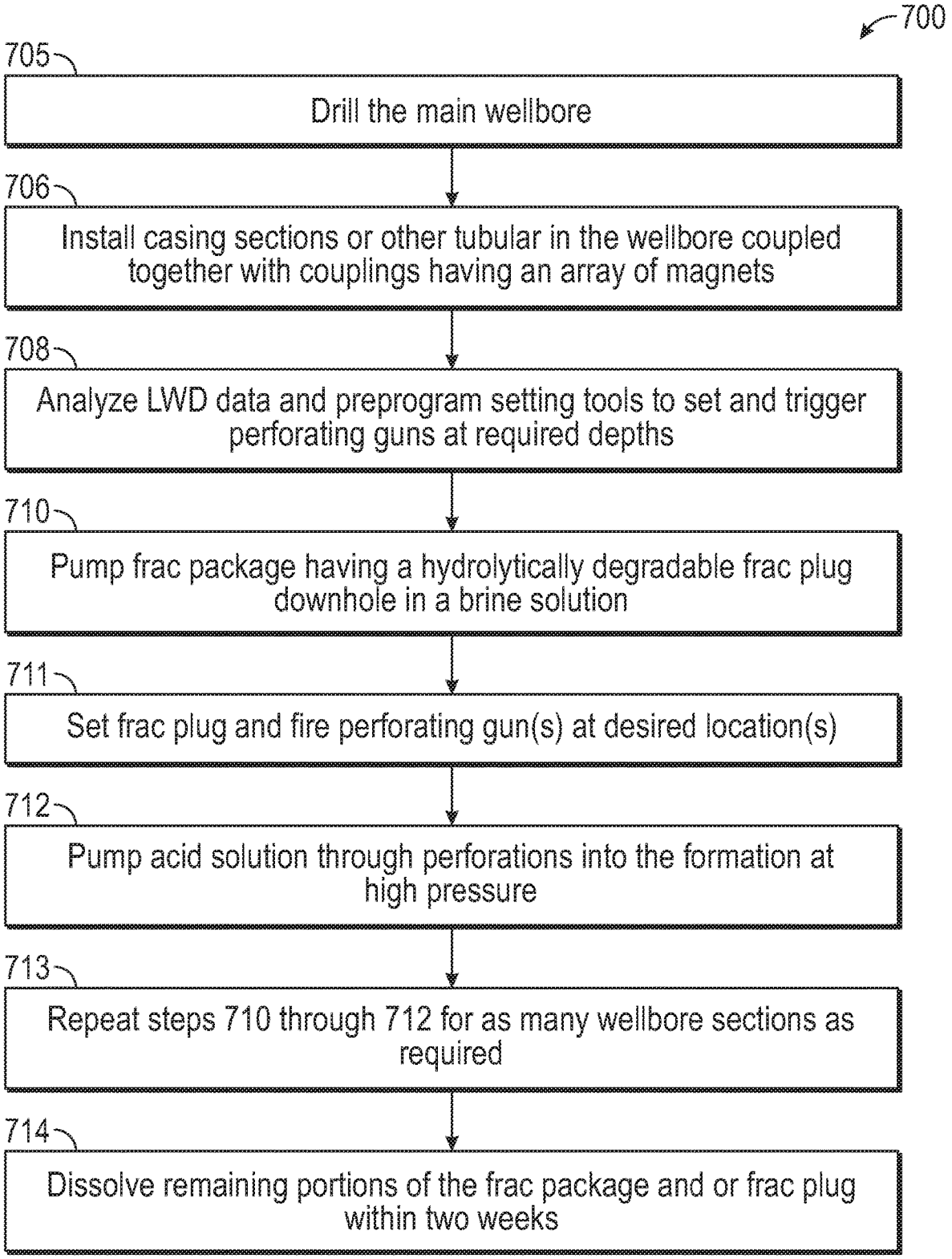
FIG. 7 is a block diagram illustrating a process of deploying the untethered dissolvable frac package downhole and performing a hydraulic acid stimulation operation.

FIG. 7. is a block diagram illustrating a process 700, which may be employed to deploy an hydrolytically dissolvable or degradable frac plug into a wellbore 12 (see FIG. 1) and perform an acid stimulation operation in the wellbore 12. First, in step 705, the main wellbore 12 is drilled. All or a portion of the wellbore 12 is then cased and cemented in step 706. In one embodiment, the entirety of the wellbore 12 length is cased and completed, where the casing string 16 contains the couplings 26, 28, 30, 32, 34 and associated array of magnets for each coupling 26, 28, 30, 32, 34. In other embodiments, other types of wellbore tubulars may be preconfigured with the couplings 26, 28, 30, 32, 34 and associated array of magnets, or other types of passive depth markers that may be detected by the setting tool 206 of a frac package 48. In step 708, logging while drilling (LWD) or other data may be analyzed to determine appropriate wellbore locations for the frac plugs 208, 208A, 208B, 208C, 208D to be set and for perforations to be formed. The controller of the setting tool 206 of one or more frac packages 48 may be preprogrammed to set providing a triggering signal to the actuator of the setting tool 206 at the appropriate depths in response to detecting one or more of the magnetic couplings 26, 28, 30, 32, 34. In step 710, the untethered dissolvable frac package 48 is pumped downhole. In some embodiments, the frac package 48 includes a frac plug 208, 208A, 208B, 208C, 208D constructed at least partially of a hydrolytically degradable polymer such as PGA, and in some embodiments, the PGA may be reinforced with fibers. In some embodiments, the dissolvable frac package 48 is pumped downhole in a brine solution 204.

In step 711, the dissolvable frac package 48 arrives at a predetermined set point position based on the preprogrammed depth programmed into the controller of the setting tool 206. In some embodiments, the controller of the setting tool 206 counts the number of times an array of magnets is passed and sets the frac plug 208, 208A, 208B, 208C, 208D once a certain count is reached. In some embodiments, the procedure proceeds immediately to step 712, and in other embodiments, the controller of the setting tool 206 is programmed to permit a predetermined time delay to elapse before proceeding to step 712. In step 712, the controller of the setting tool issues a triggering signal to the actuator of the setting tool to activate the sealing element or frac plug element 514, 614 of the frac plug 208, 208A, 208B, 208C, 208D to isolate the fracture section. The successful deployment of the frac plug 208 and engagement of the frac element with the inner wall of the casing string 16 may be determined by monitoring the wellbore 12 fluid pressure.

At step 712, an acid solution 202, 207 is pumped through the perforations into the geologic formation 20 at high pressures. The acid solution 202, 207 may have a solid content less than about 5% by weight, and any solids within the acid may be less than about 100 microns in diameter. In some embodiments, the acid solution may be pumped against the frac plug 208A, 208B, 208C, 208D at pressures of about 1000 psi to 5000 psi or higher such that the pressure forms cracks 220 (see FIG. 3) in the geologic formation 20 and the acid solution flows into the cracks. The acid solution 202, 207 may dissolve wormholes in the geologic formation 20 to facilitate production.

At step 713, steps 710 through 712 may be repeated to isolate any number of wellbore regions or zones 18A, 18B, 18C, and to conduct acid stimulation operations in those zones 18A, 18B, 18C. Portions of the dissolvable frac package 48 may degrade during steps 710 through 713, but each of the hydrolytically degradable frac plugs 208, 208A, 208B, 208C, 208D may remain intact until the acid solution 202, 207 has been pumped against the frac plug 208, 208A, 208B, 208C, 208D deployed in any particular zone 18A, 18B, 18C. At step 714, any remaining portions of the fac package 48 and/or hydrolytically degradable frac plugs 208, 208A, 208B, 208C, 208D may degrade within 2 weeks such that individual particles less than about one half inch diameter.

As described above, embodiments of the present disclosure are particularly useful for deploying frac plugs for use in acid stimulation operations. Due to the relatively low density of a frac plug constructed of a hydrolytically degradable polymers, any number of frac plugs may be pumped into a wellbore and set for conducting acid stimulation operations.

It is understood that any specific order or hierarchy of steps in the processes disclosed is an illustration of exemplary approaches. Based upon design preferences, it is understood that the specific order or hierarchy of steps in the processes may be rearranged, or that all illustrated steps be performed. Some of the steps may be performed simultaneously. For example, in certain circumstances, multitasking and parallel processing may be advantageous. Moreover, the separation of various system components in the embodiments described above should not be understood as requiring such separation in all embodiments, and it should be understood that the described program components and systems can generally be integrated together in a single software product or packaged into multiple software products.

Furthermore, the exemplary methodologies described herein may be implemented by a system including processing circuitry or a computer program product including instructions which, when executed by at least one processor, causes the processor to perform any of the methodology described herein.

While specific details about the above embodiments have been described, the above hardware descriptions are intended merely as example embodiments and are not intended to limit the structure or implementation of the disclosed embodiments In addition, certain aspects of the disclosed embodiments, as outlined above, may be embodied in software that is executed using one or more processing units/components. Program aspects of the technology may be thought of as "products" or "articles of manufacture" typically in the form of executable code and/or associated data that is carried on or embodied in a type of machine readable medium. Tangible non-transitory "storage" type media include any or all of the memory or other storage for the computers, processors or the like, or associated modules thereof, such as various semiconductor memories, tape drives, disk drives, optical or magnetic disks, and the like, which may provide storage at any time for the software programming.

Additionally, the flowchart and block diagrams in the figures illustrate the architecture, functionality, and operation of possible implementations of systems, methods and computer program products according to various embodiments of the present disclosure. It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The above specific example embodiments are not intended to limit the scope of the claims. The example embodiments may be modified by including, excluding, or combining one or more features or functions described in the disclosure.

As used herein, the singular forms "a", "an" and "the" are intended to include the plural forms as well, unless the context clearly indicates otherwise. It will be further understood that the terms "comprise" and/or "comprising," when used in this specification and/or the claims, specify the presence of stated features, integers, steps, operations, elements, and/or components, but do not preclude the presence or addition of one or more other features, integers, steps, operations, elements, components, and/or groups thereof. The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description but is not intended to be exhaustive or limited to the embodiments in the form disclosed. Many modifications and variations will be apparent to those of ordinary skill in the art without departing from the scope and spirit of the disclosure. The illustrative embodiments described herein are provided to explain the principles of the disclosure and the practical application thereof, and to enable others of ordinary skill in the art to understand that the disclosed embodiments may be modified as desired for a particular implementation or use. The scope of the claims is intended to broadly cover the disclosed embodiments and any such modification.

According to a first aspect, the present disclosure is directed to a method for conducting a hydraulic acid or proppant stimulation operation. The method includes conveying frac plug to a downhole location in a wellbore, the frac plug including a hydrolytically degradable polymer; setting the frac plug at the downhole location by radially expanding a frac plug element of the frac plug to engage a circumferential wall in the wellbore; performing an acid stimulation operation in the wellbore; and dissolving the hydrolytically degradable polymer of the frac plug in the wellbore subsequent to performing the acid stimulation operation.

In some embodiments, the performing an acid stimulation operation includes pumping an acid into the wellbore to pressurize the acid against the frac plug, forming cracks in a geologic formation surrounding the wellbore by a pressure of the acid and flowing the acid into the cracks, and dissolving wormholes in the geologic formation with the acid in the cracks. Pumping the acid into the wellbore may include increasing a pressure of the acid to at least about 1000 psi. Pumping the acid into the wellbore may include pumping an acid having a solid content less than about 5% by weight. The method may further include pumping a proppant into the formation subsequent to pumping the acid into the wellbore and prior to dissolving hydrolytically degradable polymer of the frac plug.

In one or more embodiments, conveying the frac plug to the downhole location includes pumping the frac plug downhole with a brine deployment fluid. In some embodiments, the hydrolytically degradable polymer of the frac plug includes an aliphatic polymer, and in some embodiments, the aliphatic polymer includes PGA. In some embodiments, the PGA is fiber reinforced.

In some embodiments, a frac plug element of the frac plug is constructed from a dissolvable elastomer and a lower wedge and lower slips below the frac plug element are constructed of a dissolvable metal. In some embodiments the method further includes perforating a casing in the wellbore prior to performing the acid stimulation operation.

In another aspect, the disclosure is directed to a system for conducting acid stimulation operations in a wellbore. The system includes a wellbore string disposed within a wellbore. The wellbore string including passive depth markers at predetermined positions along the wellbore string. The system includes a frac package deployable through the wellbore string by pumping a fluid through the wellbore string. The frac package includes a frac plug and a setting tool operably coupled to the frac plug to set the frac plug in response to detecting one or more of the passive depth markers. The frac plug is at least partially constructed of hydrolytically degradable polymer.

In some embodiments, a frac plug element of the frac plug is constructed from a dissolvable elastomer and a lower wedge and lower slips below the frac plug element are constructed of a dissolvable metal. The frac plug may further include upper slips and an upper wedge disposed above the frac plug element and constructed of the hydrolytically degradable polymer. The polymer is a fiber-reinforced hydrolytically degradable aliphatic polyester. In some embodiments, the system further includes a perforating gun operably coupled to the setting tool and responsive to detecting the one or more passive depth markers.

According to another aspect, the disclosure is directed to a frac package apparatus for conducting acid stimulation operations in a wellbore. The apparatus includes a frac plug at least partially constructed of hydrolytically degradable polymer, the frac plug including a frac plug element movable from a radially retracted configuration to a radially extended configuration to form a seal with a tubular string in the wellbore. The apparatus includes a setting tool operably coupled to the frac plug to move frac plug element from the radially retracted configuration to the radially extended configuration in response to detecting a passive depth marker in the wellbore.

In one or more embodiments, the frac plug element is constructed from a dissolvable elastomer and a lower wedge and lower slips of the frac plug disposed below the frac plug element are constructed of a dissolvable metal. The frac plug may further include upper slips and an upper wedge disposed above the frac plug element and constructed of the hydrolytically degradable polymer. In some embodiments, the apparatus further includes a perforating gun operably coupled to the setting tool, wherein the perforating gun and the setting tool are constructed of a dissolvable metal.

What is claimed is:

1. A method for conducting a hydraulic acid or proppant stimulation operation, the method comprising:

conveying frac plug to a downhole location in a wellbore in a water-based fluid, the frac plug including a hydrolytically degradable polymer above a sealing element of the frac plug and a dissolvable metal below the sealing element;

setting the frac plug at the downhole location by radially expanding the sealing element of the frac plug to engage a circumferential wall in the wellbore;

performing an acid stimulation operation by pressurizing an acid above the frac plug in the wellbore; and dissolving the hydrolytically degradable polymer of the frac plug in the wellbore subsequent to performing the acid stimulation operation.

2. The method according to claim 1, wherein performing an acid stimulation operation includes:

pumping the acid into the wellbore to pressurize the acid against the frac plug;

forming cracks in a geologic formation surrounding the wellbore by a pressure of the acid and flowing the acid into the cracks; and dissolving wormholes in the geologic formation with the acid in the cracks.

3. The method according to claim 2, wherein pumping the acid into the wellbore comprises increasing a pressure of the acid to at least about 1000 psi.

4. The method according to claim 2, wherein pumping the acid into the wellbore comprises pumping an acid having a solid content less than about 5% by weight.

5. The method according to claim 4, further comprising pumping a proppant into the formation subsequent to pumping the acid into the wellbore and prior to dissolving hydrolytically degradable polymer of the frac plug.

6. The method according to claim 1, wherein conveying the frac plug to the downhole location in a water-based fluid includes pumping the frac plug downhole with a brine deployment fluid.

7. The method according to claim 1, wherein the hydrolytically degradable polymer of the frac plug includes an aliphatic polymer.

8. The method according to claim 7, wherein the aliphatic polymer includes PGA.

9. The method according to claim 8, wherein the PGA is fiber reinforced.

10. The method according to claim 1, wherein the sealing element of the frac plug is constructed from a dissolvable elastomer and a lower wedge and lower slips below the sealing element are constructed of the dissolvable metal.

11. The method according to claim 1, further comprising perforating a casing in the wellbore prior to performing the acid stimulation operation.

12. A system for conducting acid stimulation operations in a wellbore, the system comprising:

a wellbore string disposed within a wellbore, the wellbore string including passive depth markers at predetermined positions along the wellbore string; and a frac package deployable through the wellbore string by pumping a fluid through the wellbore string, the frac package including a frac plug and a setting tool operably coupled to the frac plug to set the frac plug in response to detecting one or more of the passive depth markers, wherein the frac plug is at least partially constructed of hydrolytically degradable polymer above a sealing element of the frac plug and a dissolvable metal below the sealing element.

13. The system according to claim 12, wherein the sealing element of the frac plug is constructed from a dissolvable elastomer and a lower wedge and lower slips below the sealing element are constructed of the dissolvable metal.

14. The system according to claim 13, wherein the frac plug further comprises upper slips and an upper wedge disposed above the frac plug element and constructed of the hydrolytically degradable polymer.

15. The system according to claim 12, wherein the polymer is a fiber-reinforced hydrolytically degradable aliphatic polyester.

16. The system according to claim 12, further comprising a perforating gun operably coupled to the setting tool and responsive to detecting the one or more passive depth markers.

17. A frac package apparatus for conducting acid stimulation operations in a wellbore, the apparatus comprising:

a frac plug at least partially constructed of hydrolytically degradable polymer above a sealing element of the frac plug and at least one dissolvable metal below the sealing element, the sealing element movable from a radially retracted configuration to a radially extended configuration to form a seal with a tubular string in the wellbore; and a setting tool operably coupled to the frac plug to move frac plug element from the radially retracted configuration to the radially extended configuration in response to detecting a passive depth marker in the wellbore.

18. The apparatus according to claim 17, wherein the sealing element is constructed from a dissolvable elastomer and a lower wedge and lower slips of the frac plug disposed below the frac plug element are constructed of the at lease one dissolvable metal.

19. The apparatus according to claim 18, wherein the frac plug further comprises upper slips and an upper wedge disposed above the frac plug element and constructed of the hydrolytically degradable polymer.

20. The apparatus according to claim 17, further comprising a perforating gun operably coupled to the setting tool, wherein the perforating gun and the setting tool are constructed of the at least one dissolvable metal.

* * * * *